United States Patent [19]

Bigelow

[11] 4,116,697

[45] Sep. 26, 1978

[54] SULFUR-SUBSTITUTED ISOTHIOUREAS IN SILVER HALIDE EMULSIONS

[75] Inventor: John Howard Bigelow, Rochester, N.Y.

[73] Assignee: E. I. Du Pont de Nemours and Company, Wilmington, Del.

[21] Appl. No.: 871,114

[22] Filed: Jan. 20, 1978

Related U.S. Application Data

[63] Continuation of Ser. No. 751,586, Dec. 17, 1976, abandoned.

[51] Int. Cl.[2] ..... G03C 1/06; G03C 1/28

[52] U.S. Cl. ..... 96/95; 96/107; 96/109

[58] Field of Search ..... 96/107, 109, 95

[56] References Cited

U.S. PATENT DOCUMENTS

| | | | |
|---|---|---|---|
| 2,410,689 | 11/1946 | Sheppard et al. | 96/107 |
| 2,819,965 | 1/1958 | Murray et al. | 96/109 |
| 2,939,789 | 6/1960 | Dersch et al. | 96/109 |
| 3,046,130 | 7/1962 | Dersch et al. | 96/107 |
| 3,364,032 | 1/1968 | Jones | 96/107 |
| 3,954,481 | 5/1976 | Ohlschlayer et al. | 96/107 |

*Primary Examiner*—Won H. Louie, Jr.

[57] ABSTRACT

Photographic silver halide emulsions which have their sensitivity increased by the addition of sulfur-substituted isothioureas of the formula;

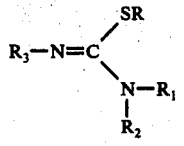

where R, $R_2$, and $R_3$ are organic radicals and $R_1$ is an organic radical or H.

10 Claims, No Drawings

SULFUR-SUBSTITUTED ISOTHIOUREAS IN SILVER HALIDE EMULSIONS

This is a continuation, of application Ser. No. 751,586 filed Dec. 17, 1976, now abandoned.

BACKGROUND OF THE INVENTION

It is known in the art to use compounds such as allylisothiourea, thiourea, thiosemicarbazide, etc. in photographic silver halide emulsions. These are normally added to the silver halide emulsion prior to digestion. If added after digestion or just prior to coating, they are found to be detrimental because they fog the emulsion when the latter is processed in continuous tone developers, and have low sensitivity response in lithographic developers. The present invention provides compounds which may be added after digestion or just prior to coating, without these detrimental effects.

SUMMARY OF THE INVENTION

This invention provides a light-sensitive silver halide photographic element comprising a support coated with a silver halide emulsion containing a sulfur-substituted isothiourea of the formula:

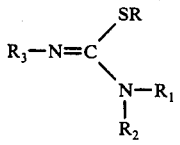

and its hydrohalide salt having the basic structure

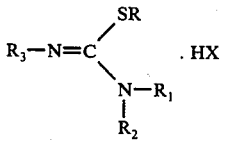

where R, $R_1$, $R_2$, and $R_3$ are each selected from the group consisting of alkyl, aryl, hetero, substituted alkyl, or substituted aryl, and wherein $R_1$ may optionally represent $H_1$ and wherein $R_2$ and $R_3$ may form a ring of two or more $>CH_2$ groups in which one or more of the H atoms may be substituted by R, and X is Cl or I. The R group is one that has no deleterious effect on silver halide, and the term "hetero" defines a group in which one or more carbon atoms in a chain have been replaced by an atom other than carbon.

DETAILED DESCRIPTION OF THE INVENTION

The use of the sulfur-substituted isothioureas of this invention in photographic silver halide emulsions results in increased Dmax and contrast, and usually increased speed. Such emulsions may be negative-type emulsions, or they may be those used in the graphic arts, e.g., lithographic materials; or those used in radiographic work, e.g., X-ray films, color films, and photographic films used for diffusion transfer processes. The silver halide in these may be silver chloride, iodide, bromide, iodobromide, or chlorobromide. Among the sulfur-substituted isothioureas suitable for use in the present invention the following are illustrative:

| Compound No. | Formula |
|---|---|
| 1. | 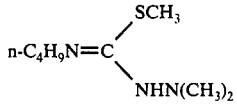 |
| | N-n-butyl-N'-dimethylamino-S-methylisothiourea |
| 2. | 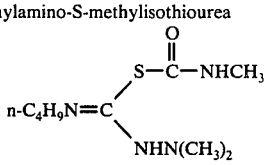 |
| | N-n-butyl-N'-dimethylamino-S-N-methylcarbamoyl-isothiourea |
| 3. | 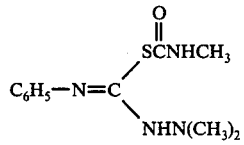 |
| | N-phenyl-N'-dimethylamino-S-N-methylcarbamoyl-isothiourea |
| 4. | 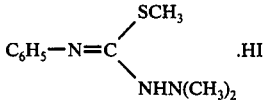 .HI |
| | N-phneyl-N'-dimethylamino-S-methylisothiourea hydroiodide |
| 5. | 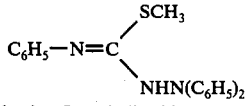 |
| | N-phenyl-N'-diphenylamino-S-methylisothiourea |
| 6. | 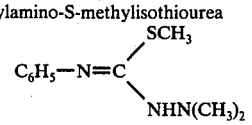 |
| | N-phenyl-N'-dimethylamino-S-methylisothiourea |
| 7. | 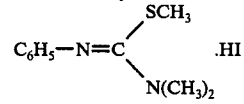 .HI |
| | N-phenyl-N'-dimethyl-S-methylisothiourea hydroiodide |
| 8. | 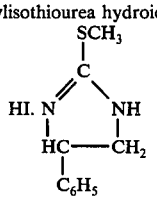 |
| | 1 phenylethylene-S-methylisothiourea hydroiodide |
| 9. | 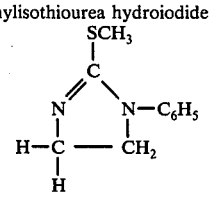 |
| | N-phenyl-ethylene-S-methyl isothiourea |
| 10. | 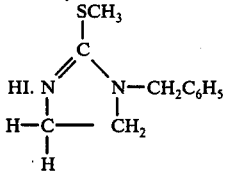 |
| | N-benzyl-S-methyl isothiourea hydroiodide |
| 11. | 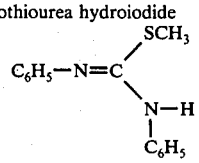 |
| | S-methyl-N,N'-diphenyl isothiourea |

-continued

| Compound No. | Formula |
|---|---|
| 12. | 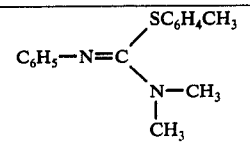 N-phenyl-S-tolyl-N'-dimethyl isothiourea |
| 13. | 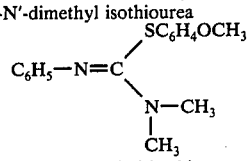 N-phenyl-S-methoxyphenyl-N'-dimethyl isothiourea |
| 14. | 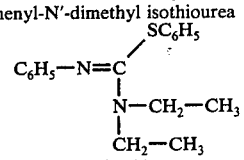 N-phenyl-N' diethyl-S-phenyl isothiourea |
| 15. | 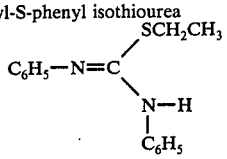 S-ethyl-N,N'-diphenyl isothiourea |
| 16. | 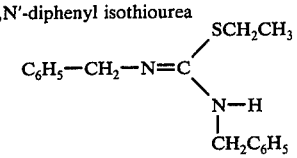 S-ethyl-N,N'-dibenzyl isothiourea |

For the preparation of the above sulfur-substituted isothiourea compounds reference may be had to: "Poudres", V. 40, p. 429, (1958), "Current Science", V. 32, p. 159, (1963) and German Pat. No. 2,035,907.

As indicated above, the sulfur-substituted isothioureas may be added to a variety of silver halide emulsions and said emulsions may contain optical sensitizing dyes, antifoggants and chemical sensitizers including conventional sulfur, noble metal and reduction-type sensitizers. The quantity of sulfur-substituted isothiourea will, of course, depend upon the particular type of emulsion and the desired effects and can vary within wide limits. The optimum amount to be added can be determined for each emulsion by simple experiment as is customary in the art of emulsion manufacture. Generally, the most suitable concentration range will be found to be from $2.01 \times 10^{-4}$ moles to $8.04 \times 10^{-3}$ moles per 1.5 moles of silver halide in the emulsion.

The following procedures and examples will serve to illustrate the invention.

In these, the compounds were added to the silver halide emulsion at the final stage of preparation of the emulsion, namely, after digestion or just prior to coating.

Silver halide emulsions were prepared according to the following procedures:

PROCEDURE A

SILVER CHLOROBROMIDE EMULSION

A gelatino-silver chlorobromide emulsion was made by rapidly adding to an acidified gelatin solution containing 1.5 moles of potassium chloride, 1.5 moles of silver nitrate in aqueous solution. There was then added 0.6 moles of potassium bromide in aqueous solution and the mixture was allowed to ripen for 10 minutes after which 0.9 moles of potassium bromide in aqueous solution was added and the emulsion was allowed to ripen an additional 10 minutes all at 160° F. The emulsion was cooled, coagulated, washed and redispersed in the manner disclosed in Moede, U.S. Pat. No. 2,772,165, which is hereby incorporated by reference.

PROCEDURE B

SILVER IODOBROMIDE EMULSION

A gelatino-silver iodobromide emulsion containing 1.6 moles percent silver iodide was made by rapidly pouring an aqueous solution containing 1.5 moles of silver nitrate plus 3.0 moles of ammonia into an aqueous gelatin solution containing 1.5 moles of potassium bromide and the required amount of potassium iodide. The resulting emulsion was neutralized, coated, coagulated, washed and redispersed in the manner disclosed in Moede, U.S. Pat. No. 2,772,165.

PROCEDURE C

A gelatino-silver iodobromide emulsion containing 1.0 mole % of iodide was made by a balanced double jet method in which both soluble silver nitrate and alkali metal iodobromide salts were added to an aqueous ammoniacal gelatin solution at a temperature of 115° F. and at a constant pAg of 8.35 to produce a 0.2 micron average grain size. The emulsion was freed from soluble salts by a coagulation wash method and redispersed as disclosed in Moede, U.S. Pat. No. 2,772,165.

PROCEDURE D

NEGATIVE-TYPE EMULSION DIGESTION

To an emulsion containing silver halide equivalent to 1.5 moles of silver nitrate and prepared by Procedures A, B or C above there was added bulking gelatin and the temperature was raised to 110° F. The pH was adjusted to 6.5. The emulsion was heated to 125° F., and there was added $3.3 - 10^{-6}$ moles of gold in the form of a conventional gold sensitizing compound and $1.7 \times 10^{-5}$ moles of a conventional sulfur sensitizing compound, specifically sodium-thiosulfate. The emulsion was then digested for 60 minutes at 125° F. The pH was then adjusted to 5.5, coating aids including a gelatin hardener were added, and the composition coated on a pohotographic quality film support and dried in a conventional manner.

EXAMPLE 1

A monodisperse silver iodobromide emulsion was made as described under Procedure C and digested as under Procedure D using $3.4 \times 10^{-4}$ moles of bis-(dimethylthiocarbamoyl)sulfide per 1.5 moles of silver halide instead of $1.7 \times 10^{-5}$ moles of the conventional sulfur sensitizer compound. Just prior to coating, $4.1 \times 10^{-3}$ moles of compound 4 per 1.5 moles of silver halide were added to the composition. A similar emulsion was made, digested and coated without the sulfur-substituted isothiourea compound to serve as a control. The coated strips were exposed in a sensitometer through a $\sqrt{2}$ step wedge by means of a lamp which provides an exposure of 4470 meter-candle-seconds, developed for 22 seconds at 100° F. in a conventional hydroquinone type developer and fixed, washed and dried. Sensitometric results are shown in the following table.

The results show the sulfur-substituted isothiourea produced increased speed, Dmax and contrast.

TABLE I

| Coating No. | Compound Added | Dmin | Dmax | Speed (D = 1.0) | Average Gradient (at Density 0.3 to 2.5) $\bar{G}$ |
|---|---|---|---|---|---|
| 1 | none-control | 0.03 | 3.31 | 100 | 2.71 |
| 2 | Compound 4 | 0.03 | 5.51 | 142 | 3.45 |

EXAMPLE 2

Two gelatino-silver iodobromide emulsions containing 1.6 mole percent silver iodide were prepared as described under Procedure B and digested according to Procedure D. To these emulsions there was added just prior to coating $4.1 \times 10^{-3}$ moles of compound 4 and compound 6, respectively per 1.5 moles of silver halide. A similar emulsion was made, digested, and coated without the sulfur-substituted isothiourea compound to serve as a control. The sensitometric strips were exposed and developed as described in Example 1. The strips were tested fresh and after being aged for 7 days in an oven at 120° F. and 65% relative humidity. (F and O in Table II)

Sensitometric results are shown in Table II. The results show increased Dmax is obtained regardless of coating pH, with or without the HI present in compound 4.

TABLE II

| Coating No. | Test Age | Compound Added | Coating pH | Dmin | Dmax |
|---|---|---|---|---|---|
| 1 | F | none-control | 7.4 | 0.07 | 3.08 |
| | O | " | | 0.04 | 2.71 |
| 2 | F | " | 5.5 | 0.07 | 2.53 |
| | O | " | | 0.04 | 3.37 |
| 3 | F | Compound 4 | 7.6 | 0.06 | 3.57 |
| | O | " | | 0.07 | 2.97 |
| 4 | F | Compound 4 | 5.5 | 0.06 | 3.57 |
| | O | " | | 0.05 | 4.16 |
| 5 | F | Compound 6 | 7.3 | 0.05 | 3.26 |
| | O | " | | 0.05 | 3.09 |
| 6 | F | Compound 6 | 5.5 | 0.04 | 2.83 |
| | O | " | | 0.04 | 3.57 |

EXAMPLE 3

Example 2 was repeated at approximately 20% higher coating weights and the samples tested by two different methods. In test method 1 the samples were exposed in a sensitometer, through a $\sqrt{2}$ step wedge by means of a lamp which provided an exposure of 29 meter-candle-seconds. The strips were processed for 1.5 mins. at 80° F. in a commercial, high contrast, lithographic, hydroquinone/formaldehyde bisulfite-type developer. Test method 2 is the same as that described in Example 1. The results obtained are shown in Table III.

TABLE III

| Coating No. | Compound Added | Test 1 Dmin | Test 1 Dmax | Test 2 Dmin | Test 2 Dmax |
|---|---|---|---|---|---|
| 1 | none-control | 0.03 | 1.43 | 0.04 | 2.92 |
| 2 | Compound 4 | 0.04 | 1.72 | 0.04 | 3.38 |
| 3 | Compound 4 | 0.03 | 1.50 | 0.03 | 3.45 |
| 4 | Compound 6 | 0.03 | 1.92 | 0.03 | 3.96 |
| 5 | Compound 6 | 0.02 | 2.20 | 0.03 | 4.54 |

The sulfur-substituted isothiourea compounds produce greater response than the control in two widely different test methods, and the presence of HI in compound 4 is not essential to the production of this effect.

EXAMPLE 4

A galatino-silver iodobromide emulsion containing 1.6 mole percent silver iodide was made and digested as described in Example 2. Various amounts of Compound 6 were added to samples of the composition as a final addition as shown in Table IV. The samples were exposed and processed as described in Example 1. The strips were tested fresh and after being aged for 7 days in an oven at 120° F. and 65% relative humidity. The results are tabulated below.

TABLE IV

| Coating No. | Compound Added (moles of compd. per 1.5 moles of silver halide) | Test Age | Dmin. | Dmax. |
|---|---|---|---|---|
| 1 | none-control | F | 0.04 | 3.21 |
| | | O | 0.03 | 3.29 |
| 2 | $8.04 \times 10^{-3}$ | F | 0.04 | 3.55 |
| | | O | 0.03 | 3.59 |
| 3 | $4.02 \times 10^{-3}$ | F | 0.04 | 4.03 |
| | | O | 0.04 | 3.35 |
| 4 | $2.01 \times 10^{-3}$ | F | 0.04 | 3.68 |
| | | O | 0.04 | 3.47 |
| 5 | $3.83 \times 10^{-4}$ | F | 0.04 | 4.04 |
| | | O | 0.04 | 4.22 |
| 6 | $2.01 \times 10^{-4}$ | F | 0.04 | 3.47 |
| | | O | 0.04 | 3.68 |

Data obtained show that a concentration range of at least $2.01 \times 10^{-4}$ to $8.04 \times 10^{-3}$ moles of compound 6 per 1.5 moles of silver halide is effective in the production of greater Dmax than the control, whether tested fresh or after oven aging.

EXAMPLE 5

A gelatino-silver iodobromide emulsion was made and digested as described in Example 2. Compound 7 was added to the emulsion as a final addition as shown in Table V. The samples were tested by test methods 1 and 2 described in Example 3 and the results are tabulated below.

TABLE V

| Ctg. No. | Additive | Test 1 Dmin | Test 1 Dmax | Test 1 Speed (D = 1.0) | Test 2 Dmin | Test 2 Dmax | Test 2 Speed (D = 1.0) |
|---|---|---|---|---|---|---|---|
| 1 | None-Control | 0.04 | 1.54 | 100 | 0.04 | 3.81 | 100 |
| 2 | $4.1 \times 10^{-3}$ moles of compd. 7/1.5 moles of silver halide | 0.05 | 2.56 | 182 | 0.05 | 3.92 | 178 |

EXAMPLE 6

Two gelatino-silver chlorobromide emulsions were made as described in Procedure A and digested as described in Procedure D. To each composition there was added just prior to coating $4.1 \times 10^{-3}$ moles of compound 7 and compound 4 respectively per 1.5 moles of silver halide. A similar emulsion was made, digested and coated without the sulfur-substituted isothiourea compound to serve as a control. The coated and dried strips were exposed and tested as described in Example 2. The results are tabulated below:

TABLE VI

| Coating No. | Compound Added | Test Age | Dmin | Dmax |
|---|---|---|---|---|
| 1 | none-control | F | 0.03 | 0.59 |
| | | O | 0.03 | 0.46 |
| 2 | Compound 7 | F | 0.04 | 0.66 |
| | | O | 0.03 | 0.71 |
| 3 | Compound 4 | F | 0.03 | 0.98 |
| | | O | 0.03 | 0.99 |

EXAMPLE 7

Example 2 was repeated except that the sulfur-substituted isothioureas indicated by number in Table VII were added as final additions. The sensitometric strips were exposed and developed as described in Example 1 to give the following results.

TABLE VII

| Ctg. No. | Compound added (grams of compd. per 1.5 moles of silver halide) | Dmin | Dmax | Speed (D=1.0) | Average Gradient $\overline{G}$ (D=0.3 to 2.5) |
|---|---|---|---|---|---|
| 1 | none-control | 0.04 | 3.24 | 100 | 3.09 |
| 2 | 0.8 grams of Compound 1 | 0.06 | 3.94 | 214 | 4.34 |
| 3 | 0.8 grams of Compound 2 | 0.06 | 3.42 | 148.5 | 2.39 |
| 4 | 0.136 grams of Compound 3 | 0.05 | 4.41 | 50 | 3.68 |
| 5 | 0.8 grams of Compound 4 | 0.05 | 4.14 | 94 | 3.91 |

The sulfur-substituted isothiourea compounds show greater response than the control. Although not all the compounds increase response in exactly the same way, as might be expected, all give higher Dmax than the control.

EXAMPLE 8

Example 6 was repeated except that the sulfur-substituted isothioureas indicated by numbers in Table VIII were added as final additions in the amount of $4.1 \times 10^{-3}$ moles per 1.5 moles of silver halide. The sensitometric strips were exposed and developed as described in Example 1 to give the following results.

TABLE VIII

| Coating No. | Compound Added | Test Age | Dmin | Dmax |
|---|---|---|---|---|
| 1 | none-control | F | 0.04 | 3.20 |
| | | O | 0.04 | 3.42 |
| 2 | Compound 1 | F | 0.07 | 4.63 |
| | | O | 0.13 | 4.92 |
| 3 | Compound 5 | F | 0.04 | 4.25 |
| | | O | 0.04 | 3.71 |
| 4 | Compound 6 | F | 0.05 | 4.11 |
| | | O | 0.05 | 4.20 |

These data show that the sulfur-substituted isothiourea compounds are capable of producing emulsions with greater response than the control.

EXAMPLE 9

A silver chlorobromide emulsion was prepared according to Procedure A, digested according to Procedure D, and coated in a conventional manner. Just prior to coating, $4.1 \times 10^{-3}$ moles of compound 8 were added to the composition. A similar control emulsion was prepared, digested and coated without the sulfur-substituted isothiourea. Samples were tested as in Example 1. The results are shown in Table IX.

TABLE IX

| Coating No. | Compound Added | Test Age | Dmin | Dmax | Speed (D=1.0) |
|---|---|---|---|---|---|
| 1 | none | F | .04 | 1.61 | 100 |
| | | Oven | .04 | 1.49 | 31 |
| 2 | Compound 8 | F | .04 | 1.73 | 163 |
| | | Oven | .04 | 3.03 | 277 |

As indicated in the various examples, the novel sulfur-substituted isothioureas may be used in silver halide systems in conjunction with known sensitizers, i.e., sulfur and noble metal salt compounds. There may also be used reducing agents, e.g., stannous salts, compounds which sensitize by development acceleration, e.g., polyoxyethylene compounds and the polyhedral boranes disclosed in Bigelow, U.S. Pat. Nos. 3,779,777 and Bigelow, 3,761,275. In addition, optical sensitizing dyes can be used in the silver halide emulsion systems using the novel sulfur-substituted isothioureas of this invention.

The silver halide emulsions of this invention can be made with any of the macromolecular, water-permeable colloids known to be suitable for the purpose of acting as a colloid carrier for silver halide grains. A conventional colloid binder useful for this purpose is gelatin. The emulsions can also contain conventional additions such as plasticizers for the colloid carrier in which the silver halide crystals are dispersed, and antifoggants such as thiazoles, triazoles, tetraazaindenes and the like. Other silver salts in addition to those mentioned above may also be used for the invention.

The silver halide emulsions may be coated on any suitable support including photographic quality paper and transparent film. For example, the cellulosic supports such as cellulose nitrate, cellulose acetate, cellulose triacetate, cellulose mixed esters, etc., may be used. Polymerized vinyl compounds, e.g., copolymerized vinyl acetate and vinyl chloride, polystyrene, and polymerized acrylates may also be used; also the film formed from certain polyesters, preferably those obtainable by condensing terephthalic acid or dimethyl terephthalate with diethylene glycol. The emulsions are generally coated on the supports to give a coating weight of about 20–100 mg/dm$^2$ of silver halide when dry.

I claim:

1. A light-sensitive silver halide photographic element comprising a support coated with a silver halide emulsion containing a sulfur-substituted isothiourea of the formula:

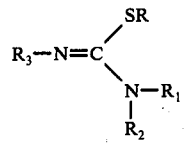

or its hydrohalide salt having the formula

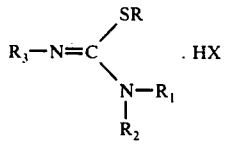

where R, $R_1$, $R_2$, and $R_3$ are each selected from the group consisting of alkyl, aryl, hetero, substituted alkyl, and substituted aryl, and wherein $R_1$ may optionally represent H, and X is iodine or chlorine, said isothiourea or its salt being employed in an amount sufficient to increase the Dmax and contrast of the silver halide emulsion.

2. The photographic element of claim 1 wherein said isothiourea is N-n-butyl-N'-dimethylamino-S-methylisothiourea.

3. The photographic element of claim 1 wherein said isothiourea is N-n-butyl-N'-dimethylamino-S-N-methylcarbamoylisothiourea.

4. The photographic element of claim 1 wherein said isothiourea is N-phenyl-N'-dimethylamino-S-N-methylcarbamoylisothiourea.

5. The photographic element of claim 1 wherein said isothiourea is N-phenyl-N'-dimethylamino-S-methylisothiourea hydroiodide.

6. The photographic element of claim 1 wherein said isothiourea is N-phenyl-N'-diphenylamino-S-methylisothiourea.

7. The photographic element of claim 1 wherein said isothiourea is N-phenyl-N'-dimethylamino-S-methylisothiourea.

8. The photographic element of claim 1 wherein said isothiourea is N-phenyl-N'-dimethyl-S-methylisothiourea hydroiodide.

9. A light-sensitive silver halide photographic element comprising a support coated with a silver halide emulsion containing a sulfur-substituted isothiourea of the formula:

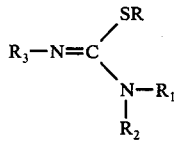

or its hydrohalide salt having the formula

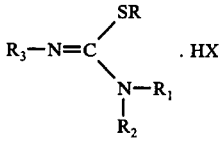

wherein R is selected from the group consisting of alkyl, aryl, and substituted aryl; $R_1$, $R_2$, and $R_3$ are each selected from the group consisting of alkyl, aryl, hetero, substituted alkyl, and substitued aryl, and wherein $R_1$ may optionally represent H, and wherein $R_2$ and $R_3$ may form a ring of two or more $> CH_2$ groups in which one or more of the H atoms may be substituted by R, and wherein X is iodine or chlorine, said isothiourea or its salt being employed in an amount sufficient to increase the Dmax and contrast of the silver halide emulsion.

10. The photographic element of claim 9 wherein said isothiourea is 1-phenylethylene-S-methyl-isothiourea hydroiodide.

* * * * *